US006378611B1

(12) United States Patent
Helderle

(10) Patent No.: US 6,378,611 B1
(45) Date of Patent: Apr. 30, 2002

(54) PROCEDURE AND DEVICE FOR TREATING WELL PERFORATIONS

(75) Inventor: Paul Maxime Helderle, Champdeuil (FR)

(73) Assignee: Total Fina S.A., Puteaux (FR)

( * ) Notice: Subject to any disclaimer, the term of this patent is extended or adjusted under 35 U.S.C. 154(b) by 0 days.

(21) Appl. No.: 09/563,859

(22) Filed: May 4, 2000

(30) Foreign Application Priority Data

May 5, 1999 (FR) ..... 99 05701

(51) Int. Cl.[7] ..... E21B 29/02; E21B 37/00
(52) U.S. Cl. ..... 166/311; 166/299; 166/63
(58) Field of Search ..... 166/63, 276, 278, 166/280, 299, 311

(56) References Cited

U.S. PATENT DOCUMENTS

| | | | | |
|---|---|---|---|---|
| 3,121,465 A | | 2/1964 | Stephens | 166/164 |
| 3,630,284 A | | 12/1971 | Fast et al. | 166/299 |
| 3,721,191 A | | 3/1973 | Hastings | 102/20 |
| 3,721,297 A | | 3/1973 | Callacombe | 166/299 |
| 3,871,455 A | | 3/1975 | Hardy et al. | 166/288 |
| 4,530,396 A | | 7/1985 | Mohaupt | 166/63 |
| 4,633,951 A | | 1/1987 | Hill et al. | 166/308 |
| 4,757,863 A | * | 7/1988 | Challacombe et al. | 166/299 |
| 4,976,318 A | | 12/1990 | Mohaupt | 166/311 |
| 5,178,218 A | | 1/1993 | Dees | 166/281 |
| 5,316,087 A | * | 5/1994 | Manke et al. | 166/381 |
| 5,402,846 A | | 4/1995 | Jennings, Jr. et al. | 166/259 |
| 5,551,344 A | | 9/1996 | Couet et al. | 102/312 |
| 5,775,426 A | | 7/1998 | Snider et al. | 166/308 |
| 6,138,753 A | * | 10/2000 | Mohaupt | 166/250.02 |
| 6,158,511 A | * | 12/2000 | Wesson | 166/308 |

* cited by examiner

*Primary Examiner*—David Bagnell
*Assistant Examiner*—Jennifer R. Dougherty
(74) *Attorney, Agent, or Firm*—Sughrue Mion, PLLC

(57) ABSTRACT

A procedure for treating the perforations of a well, in particular by intervention of a cable, in order to plug them or consolidate them comprises the successive steps of:

(a) arranging, close to the perforation to be treated (50, 54), a dehydration powder chamber (32) that produces a large volume of high pressure gas at a high temperature, as well as a composite powder chamber (40) designed to treat the perforation (50, 54);

(b) igniting the dehydration powder; and (c) once the combustion of the dehydration powder is completed, igniting the composite powder so the treatment of the perforation (50, 54) can take place.

The invention also relates to a device for implementing this procedure.

24 Claims, 3 Drawing Sheets

PROCEDURE AND DEVICE FOR TREATING WELL PERFORATIONS

The invention relates to a procedure and a device for treating well perforations, in particular through wireline work.

BACKGROUND OF THE INVENTION

When a well is drilled, the final architecture of its completion usually depends strongly on its profile and the layering of the geological reservoirs encountered.

By "completion" we mean the final installation of the production tubing as well as all auxiliary equipment for bringing in a well.

The characteristics of the reservoirs such as pressure, bottom temperature, permeability, porosity, height of the area of interest, height of the stretch of water, type of compacted, deconsolidated or gritty sandy formation, expected well or injection yields, etc., make it possible to choose the "layer/hole" link system that is best suited to the various reservoirs identified and selected as the possible water, oil or gas producer or injector.

Problems may occur when exploiting a well. For the most part, these problems are the following:

- an area starts experiencing an abnormal production of water,
- an area starts to cave in and produce sand,
- the pressure of an area decreases to the point where its production ceases,
- the percentage of gas produced by an oil area increases abnormally As soon as one of these problems becomes apparent, it is important to react quickly in order to avoid any harmful effects and prevent the situation from worsening which could result in considerable production losses and therefore a loss of profitability.

Until now, several techniques were used to resolve the issues tied to these problems.

FIG. 1 represents a situation commonly called "Selective completion". In a drilled hole 1 surrounded by a casing 2 and waterproof cement 3, and in which is located a production tubing 4 equipped with bringing in sliding sleeves 6 and 7, packers 5, 8 and 10 are arranged so as to isolate the areas of perforation Z4, Z5 and Z6 to be treated. Stopping or consolidating the perforations then requires the use of a complex drilling device as the traction capacity of the latter must be sufficient to remove the existing completion and reinstall a new one after the stopping or consolidation.

These operations also require that the annular spaces between the production casing and the production tubing be filled with fluids that are designed to counterbalance the pressures of the various reservoirs. We then risk damaging certain areas that are sensitive to these fluids, for example clayey areas that may intumesce.

The operations that must be carried out under the lower packer 10 can be performed using a technique known to the man of the art under the name "Coil tubing" or that known under the name "Snubbing". Unfortunately, these techniques have the disadvantage of requiring that an area be abandoned by injection of polymer resins when the temperature of the area is compatible with the chemical formulation of the resin, or the cement. Thus, any perforated area that still has potential for production is lost when is it located under a resin or cement plug.

FIG. 2 represents a situation commonly called "Multiarea completion" where the areas to isolate or consolidate are located under the production packer 11. In this case, it is possible to use "Snubbing" or "Coil rubbing" or to function using an electrical line wireline work unit with isolation by inflatable packet 12. Access to all perforated areas is possible, however, we still lose areas Z7, Z8 located under the inflatable packer 12.

FIG. 3 represents a situation commonly called "Monobore completion" where the production tubing is none other than the casing. In this case, all perforated areas are accessible from one same diameter and therefore it is much easier to isolate a perforated area by injecting cement or anchoring a liner using the wire line work unit than it is in the previous cases. One may also use a liner 13 of the "Patch" type which can be found on the market and has a fine malleable envelope. Unfortunately, these patches can only efficiently guarantee the isolation of an area when the pressure of the reservoir is less than the pressure that prevails in the production tubing, because of a flattening effect. As this situation is quite infrequent, we use patches with envelopes that are hard and thicker in order to be able to guarantee a bidirectional waterproof quality. The disadvantage of these patches comes from the fact that their removal often creates a problem and therefore it is no longer possible to place another patch at a lower level.

These isolation or consolidation techniques of a perforation area are very delicate as there is a high risk of damaging certain perforation intervals that have great potential. Furthermore, they require stopping the production for long periods of time, often 8 to 15 days, which creates a significant shortfall that needs to be made up.

Therefore it would be interesting to have a system that makes it possible to intervene, preferably by wire line, in a production tubing, even of small diameter, while only requiring that the production be interrupted for a short period of time.

In addition, such a system should be able to be used in all cases represented in the figures.

SUMMARY OF THE INVENTION

The applicant has been able to develop a procedure and a device that make it possible to treat the perforations of a well, in order to plug or isolate them, which resolves the problems and corrects the weaknesses that have just been mentioned.

The procedure as set forth in the invention consists mainly of the following successive steps:

(a) a dehydration powder chamber that produces a large volume of high pressure gas at a high temperature and a composite powder chamber designed to treat the perforation are arranged close to the perforation to be treated;

(b) the dehydration powder is set on fire;

(c) once the combustion of the dehydration powder is over, the composite powder is set on fire so the treatment of the perforation may take place.

The device as set forth in the invention consists essentially of:

- means of locating and positioning the device inside the well;
- a first chamber designed to contain dehydration powder and capable of freeing the gases produced during the combustion of the dehydration powder located close to the perforation to be treated;
- a second chamber designed to contain composite powder and capable of freeing the gases and other components produced during the combustion of the composite powder at a point located close to the perforation to be treated;

means of igniting the powder contained in the first chamber;

means of igniting the powder contained in the second chamber once the combustion in the first chamber is over.

Thus, according to a first method of execution of the invention, the composite powder consists at least of propulsive combustible powder and an alloy designed to plug the perforation.

According to a second method of execution of the invention, the composite powder contains propulsive combustible powder and consolidation beads, so as to consolidate the perforation.

BRIEF DESCRIPTION OF THE FIGURES

Other characteristics and advantages of the procedure and device as set forth in the invention will become apparent when reading the remainder of the description to which are attached FIGS. 1 through 7 as illustrations thereof.

DETAILED DESCRIPTION OF THE INVENTION

The invention can be applied to oil, gas or water production wells, as well as to wells in which these elements are injected.

After drilling a well, in order to be able to exploit it, it is necessary to establish layer/hole connections with the reservoir to be used. In general this is done using shaped blasting charges designed to perforate the production casing as well as the cement and the formation, and arranged in a cannon. Using a cable or a tube, this cannon is lowered with great precision plumb over the area to be perforated thanks to both diagraphic measurements of the reference logarithm based on the measurement of the natural radioactivity of the rocks (gamma rays) and a comparison with the values measured by a threaded collar sensor or an excessive thickness sensor (called "Casing Collar Locator" and CCL in the remainder of the description), where these values indicate the position of the threaded collars of each packer of the production tubing or casing.

Once the cannon is lodged at the desired depth, firing is triggered from the surface by sending an electric current or by using any other means such as pressurization of the production tubing, etc.

Figure 4:
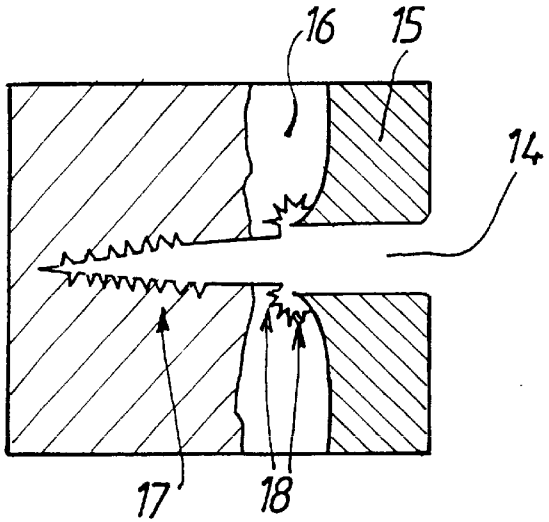
FIG.4 PRIOR ART
FIG. 4 represents the details of a traditional perforation.

As can be seen in FIG. 4, the energy emitted by the explosion creates a hole 14 in the tubing or casing 15, it then passes through the water tightness cement 16 of the casing and enters the geological formation 17 until the energy is completely dissipated. The hole 14 that has been created may have a diameter of 0.4 to 2 cm and a depth from 5 to more than 80 cm depending on the soils. The average volume of a hole 14, whose usual shape is that of a cone, usually ranges between 5 and 20 $cm^3$. The hole shows an irregular cross section. The inside surface of the casing around the hole has no burrs and is usually slightly concave. The outside part of the casing around the hole is fringed with sharp burrs 18 that form peaks whose lengths usually reach half of the thickness of the perforated casing tube, or 0.5 to 0.7 cm.

The distribution of the perforations is usually from 1 to 8 perforations over a 30 cm circumference. Preferably, the distribution of the perforations is helical over 360 degrees so as to improve the drainage of the perforated area.

In order to be able to be inserted in the well to be treated, the device as set forth in the invention consists of an overall cylindrical shape.

It can be used with a traction system when the well is particularly deviated or with a snubbing or coil tubing unit when the intervention has to be carried out in a horizontal drain or in sections of completion. In addition, it is preferably modular, allowing for a quick replacement of its elements and a quick reactivation.

Also, it is advantageously equipped with a temporary locking system designed to hold the overall system in place without any risk of ejection toward the top or propulsion toward the bottom. This locking can be electric or powder based and must be activated before igniting the dehydration powder. The latter must produce enough gas to dehydrate the perforations to be treated and, when a plugging is sought, it must bring the temperature in the perforations to a temperature that is greater than the melting point of the plugging alloy. The quantity of composite powder, then consisting of a propulsive combustible powder and a fluxing alloy at a predetermined temperature based on the area to be treated, must be sufficient to plug all desired perforations.

For the isolation as well as for the plugging of perforations, the chamber that contains the composite powder is equipped with means that make it capable of providing the gases and other products emitted by the combustion of the powder with a helical movement so that the perforations distributed over the entire circumference of the casing can be treated. Furthermore, the composite powder chamber is advantageously equipped with three separate compartments equipped with metallic control beads of small diameter for the lower compartment and of increasing diameter for the upper compartments. The diameter of these beads is preferably less than the radius of the perforation.

The device as set forth in the invention will also preferably consist of feeding powder chambers capable of freeing the gases produced during the combustion of the feeding powder and are installed at points located, respectively, above and under the perforation or the perforation area to be treated. Thus, the feeding powder is ignited before the composite powder is ignited so as to create upper and lower dynamic waterproofing, meaning located above and below the perforation or the perforation area to be treated; then we maintain the combustion of the feeding powder at least for the duration of the combustion of the composite powder. The execution of this dynamic waterproofing allows for watertightness without parts in motion, which makes it possible, with one single device, to treat a multitude of cases without however the need for complex handling systems.

Preferably, a chamber containing placement and cleaning powder is provided for in order to guarantee cleaning of the device, minimize the risk of jamming and sufficiently cool the perforations using an expansion effect on the edge of the perforations and, if necessary, in order to solidify the plugging alloy.

The device is advantageously equipped with centralizers in order to avoid, after the plugging operations, any risk of adhesion by the resolidified melted particles stuck against the walls of the casing.

EXAMPLES OF IMPLEMENTATION OF THE INVENTION

Plugging the Perforations

Figure 5:
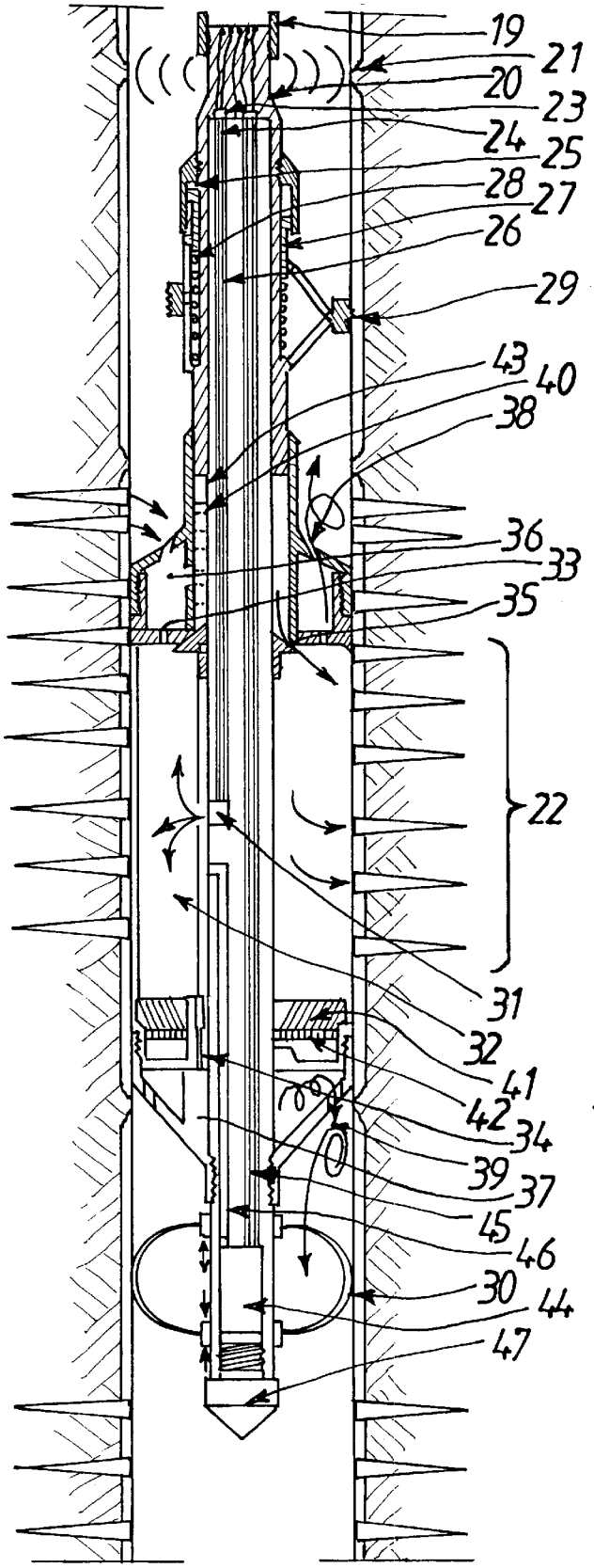
FIG. 5 represents the device as set forth in the invention positioned inside a well.

The device as set forth in the invention and represented in FIG. 5 is lowered by its upper extremity using an electric cable and the packer 19. Thanks to the CCL 20, it can position itself at the desired location because when the CCL detects the presence of the collar 21, it orders the lowering to stop. Thus, the upper dynamic watertightness deflector is located above the perforation area 22 to be treated and the lower dynamic watertightness deflector will be located below them.

By sending an electric current through the electric wires that accompany the cable, we ignite the primary detonator 23 which lights a fuse 24 that goes to the charge 25 of the locking centralizer and is extended by an extension 26 that continues toward the bottom. The combustion of the charge 25 causes the development and expansion of gases that push the piston 27 toward the bottom and compress the return spring 28. The anchor plates 29 connected to the piston 27, move toward the sides of the well and come in contact with the casing of the well. The pressure they then exert against this casing prevents any possibility of movement by the device that at that time is kept perfectly centered in the casing by the anchor plates 29 as well as by the lower centralizer 30 located at the lower extremity of the device.

The extension 26 of the fuse 24 continues to burn during a fraction of a second then detonates a shaped charge 31 located in the middle of the dehydration powder chamber 32. The ignition of the latter creates a large volume of high pressure gas at a high temperature.

The dimensions of the device are such that the dehydration powder chamber 32 is located close to the perforations 22 to be treated. Thus, most of the volume of gas creates will heat the perforations 22 and the formation of the well that surrounds them, which disintegrates any trace of paraffin or hydrocarbon.

The combustion of the dehydration powder ignites the fuses 33, 34 and 35. The fuses 33 and 34 are slow and are located, respectively, in the upper and lower parts of the dehydration powder chamber 32. The fuse 33 communicates with an upper chamber 36 of powder called feeding powder and the fuse 34 communicates with a lower chamber 37 also of feeding powder.

During the combustion of the fuses 33 and 34, the high pressure gases injected into the perforations level out with the surrounding pressure, then when the fuses 33 and 34 ignite the feeding powder chambers 36 and 37, a combustion gas jet emanates from the latter. It respectively emanates from the upper part 38 of the upper chamber 36 and the lower part 39 of the lower chamber 37. The respective outputs of the gas jets are oriented so as to create rotating gas jets. The dynamic watertightness created in this way prevents any excessive pressure or negative pressure from outside the area of perforations to be treated from communicating with the latter.

During this time, the fuse 35 which is even slower than the fuses 33 and 34 continues to burn. It in turn ignites the composite powder chamber 40. This composite powder consists of a propulsive combustible powder, an alloy designed to plug the perforation and control beads.

Under the effect of the pressure of the combustion gas, a fuse valve with a streamlined blade shape opens and lets everything out while giving it a helical movement, the gases, the control beads as well as the alloy particles that start to melt.

As the alloy and the control beads are freed from the upper level of the perforation area 22 to be treated and are heavier than the combustion gases, they are carried away by centrifugation in the perforations of the area 22 until the latter can no longer absorb the alloy or the control beads.

The control beads that were unable to penetrate the perforations are carried away by centrifugation to the bottom part of the area to be treated where they come up against metallic baffles 41 slanted in the opposite direction to that of their sense of rotation and fall on a magnetized sieve 42 designed to evaluate the quality of the treatment and determine if a new treatment is necessary.

The quantity of feeding powder contained in the chambers 36 and 37 is calculated so the combustion of this powder will continue at least until the combustion of the composite powder is completed. At the end of the combustion of the composite powder, the upper part of the composite powder chamber 40 ignites the placement and cleaning powder chamber 43. The combustion of the latter plays a final displacement role for the remainder of the powder as well as a cleaning role in order to eliminate the alloy particles that are located outside the perforations, in particular those that were able to attach themselves between the device and the inside of the casing.

Once the combustion of the powder contained in the chamber 43 is completed, the pressures level out very rapidly thanks to the spaces left by the combustion of the shaped charge 31, the fuses 24, 33 and 34, the extension 26, and to the openings of the upper part 38 of the chamber 36 and the lower part 39 of the chamber 37. This results in the return spring 28 bringing the piston 27 back to its retracted position and the anchor plates 29 toward the axis of the well.

The device can then be brought back up to the surface.

The device can advantageously be equipped with a pressure and temperature recorder 44 that transmits the pressure and temperature values using a cable 45 after capturing them via its pressure and temperature taking conduit 46 and using a plug 47.

Consolidation of the Perforations

To consolidate perforations, we proceed as for plugging perforations, except that we replace the alloy used in the composite powder with calibrated consolidation beads.

These beads are non magnetic stainless steels micro-beads whose diameter is compatible with the gradation of the formation sands to be consolidated. In order to avoid any movement from these micro-beads after they agglomerate in a perforation, they are previously treated with a copper plating followed by a contact tinning designed for their final junction after cooling.

Results

Figure 3:
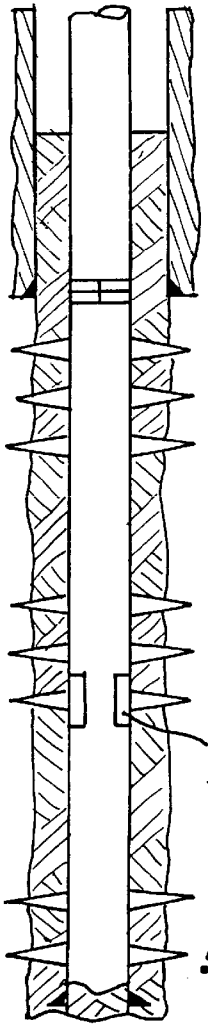
FIG.3 PRIOR ART
FIG. 3 represents a well in the configuration called "Monobore completion".
Figure 2:
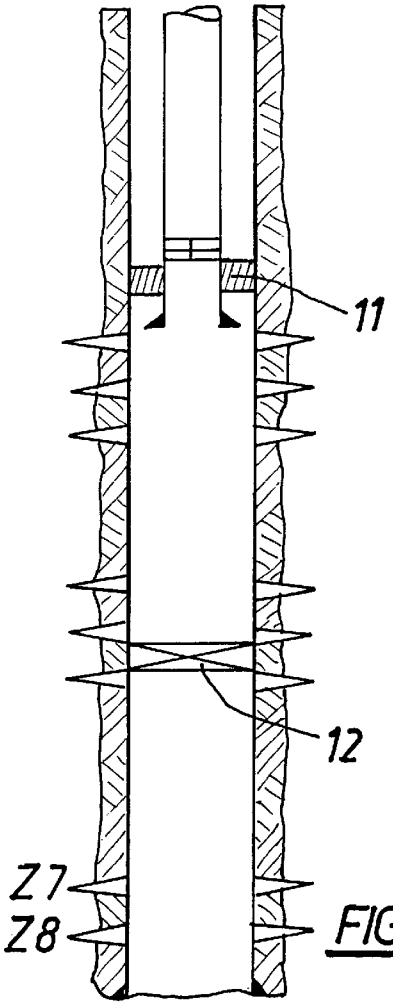
FIG.2 PRIOR ART
FIG. 2 represents a well in the configuration called "Multiarea completion".
Figure 1:
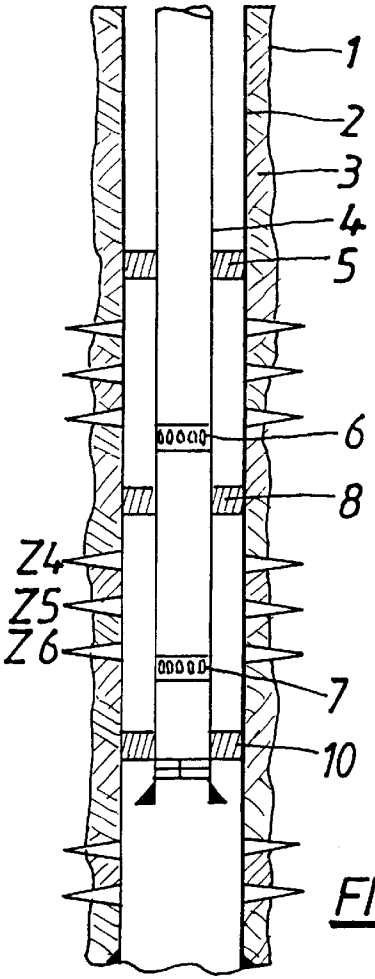
FIG.1 PRIOR ART
FIG. 1 represents a well in the configuration called "Selective completion".
Figure 6:
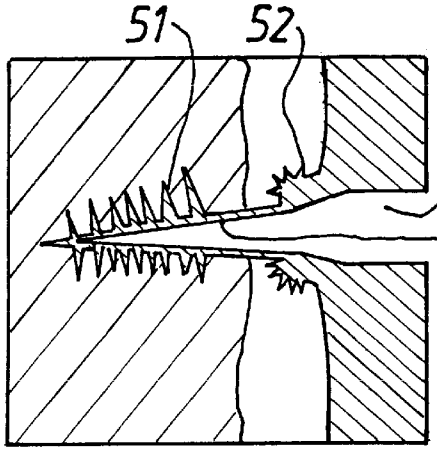
FIG. 6 represents the details of a perforation plugged using the procedure as set forth in the invention.

FIG. 6 represents a cut-away of a perforation 50 isolated as set forth in the invention. We note that the alloy first perfectly fills the micro-fractures 51 of the perforation and the voids 52 of the damaged cement to later flatten itself over the overall internal surface 53 of the perforation. A high resistance internal watertight coating then forms because it perfectly hugs the specific shapes of the perforation.

The dehydration of the perforations prior to the injection of the melting alloy avoids all pollution of the latter and guarantees a good adherence to the porous and absorbing walls of the formation.

The steel beads of increasing size that are used during the plugging operation make it possible to evaluate if the quantities of injected alloy are sufficient or if the operation must be repeated.

Advantageously we choose an alloy that is insensitive to the chemical attacks that can be produced by most hydrocarbons and formation waters. Contrary to the watertightness obtained through elastomers or polymer resins, the hold of the alloy is not altered by the surrounding bottom temperature.

Furthermore, contrary to the techniques of the prior art, the alloy's solidification time is only of a few seconds and therefore the well can be put back in production as soon as the system has be recuperated at the surface.

Figure 7:
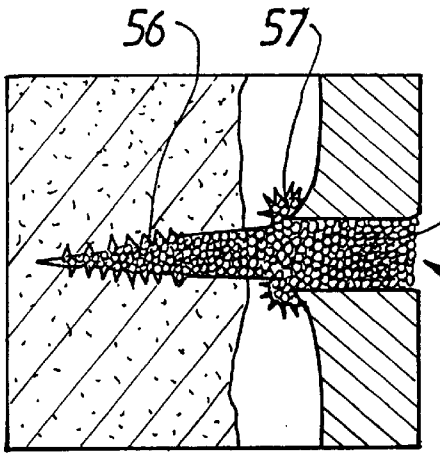
FIG. 7 represents the details of a perforation consolidated using the procedure as set forth in the invention.

FIG. 7 represents a cut-away of a perforation 54 consolidated as set forth in the invention. We note that the steel beads 55 first perfectly fill the micro-fractures 56 of the perforation and the voids 57 of the damaged cement to later compact in any volume of the perforation.

Thus, any movement of formation sand in the perforation is prevented due to the piling of the sand caused by the beads held together by a pewter base binder. Indeed, each bead finds itself soldered to approximately fourteen other beads and any movement by the beads is made impossible by the existence of the micro-fractures and the burr fringes located on the outside of the casing.

The dehydration of the perforations before the injection of the beads avoids all pollution of the latter and guarantees a maximum porosity of the bead network as well as minimum damage to the porous and absorbing walls of the perforation.

The steel beads of increasing size make it possible to evaluate if the quantity of injected beads is sufficient or if the operation must be repeated.

What is claimed is:

1. A procedure for the treatment of a perforation (50, 54) of a well, comprising the following successive steps:

(a) arranging, close to the perforation to be treated (50, 54), a dehydration powder chamber (32) that produces a large volume of high pressure gas at a high temperature, as well as a composite powder chamber (40) designed to treat the perforation (50, 54);

(b) igniting the dehydration powder; and (c) once the combustion of the dehydration powder is complete, automatically igniting the composite powder so the treatment of the perforation (50, 54) can take place.

2. The procedure as set forth in claim 1, further comprising:

during step (a), positioning feeding powder chambers (36) having feeding powder and capable of freeing the gases created during the combustion of the feeding powder at points located, respectively, above and below the perforation (50, 54) to be treated;

before igniting the composite powder, igniting the feeding powder so as to create dynamic watertightness above and below the perforation (50, 54) to be treated; and maintaining the combustion of the feeding powder for at least the duration of the combustion of the composite powder.

3. The procedure as set forth in claim 2, further comprising:

during step (a), positioning, close to the perforation (50) to be treated, a placement and cleaning powder chamber (43) having a placement and cleaning powder; and once the combustion of the composite powder is complete and the perforation is plugged, igniting the placement and cleaning powder so as to eliminate the particles that are located outside the plugged perforation.

4. The procedure as set forth in claim 1, wherein the composite powder contains propulsive combustible powder and an alloy designed to plug the perforation.

5. The procedure as set forth in claim 4, wherein the composite powder also contains control beads.

6. The procedure as set forth in claim 1, wherein the composite powder consists of propulsive combustible powder and consolidation beads, so as to consolidate the perforation.

7. The procedure as set forth in claim 1, wherein said composite powder is automatically ignited by the combustion of the dehydration powder.

8. A procedure for the treatment of a perforation area (22) of a well, comprising the following successive steps:

(a) arranging, close to the perforation area to be treated (22) a dehydration powder chamber (32) that produces a large volume of high pressure gas at a high temperature, as well as a composite powder chamber (40) designed to treat perforations of the area (22);

(b) igniting the dehydration powder; and (c) once the combustion of the dehydration powder is complete, automatically igniting the composite powder, giving a helical movement to the gases and the particles of the composite powder freed during the combustion, so the treatment of the perforations of the entire area (22) can take place.

9. The procedure as set forth in claim 8, further comprising:

during step (a), positioning feeding powder chambers having feeding powder and capable of freeing the gases created during the combustion of the feeding powder at points located, respectively, above and below the perforation area to be treated;

before igniting the composite powder, igniting the feeding powder so as to create dynamic watertightness above and below the perforation area to be treated; and maintaining the combustion of the feeding powder for at least the duration of the combustion of the composite powder.

10. The procedure as set forth in claim 9, further comprising:

during step (a), positioning, close to the perforation area to be treated, a placement and cleaning powder chamber having a placement and cleaning powder; and once the combustion of the composite powder is complete and the perforations in the perforation area are plugged, igniting the placement and cleaning powder so as to eliminate the particles that are located outside the plugged perforations.

11. The procedure as set forth in claim 8, wherein the composite powder contains propulsive combustible powder and an alloy designed to plug the perforations of the area.

12. The procedure as set forth in claim 11, wherein the composite powder also contains control beads.

13. The procedure as set forth in claim 8, wherein the composite powder consists of propulsive combustible powder and consolidation beads, so as to consolidate the perforations.

14. A device for treating a perforation (50, 54) of a well, comprising:

means for localizing and positioning (19, 20) the device inside the well;

a first chamber (32) containing dehydration powder and adapted to free gases produced during combustion of the dehydration powder and located close to the perforation to be treated (50, 54);

a second chamber (40) containing composite powder and adapted to free gases and other components produced during the combustion of composite powder at a point located close to the perforation to be treated (50, 54);

means (23, 24, 26) for igniting the powder contained in the first chamber (32); and means (35) for automatically igniting the powder contained in the second chamber (40) once the combustion in the first chamber (32) is complete.

15. The device as set forth in claim 14, further comprising:

a third chamber (36) containing feeding powder and adapted to free gases produced during combustion of the feeding powder at a point located above the perforation to be treated, so as to create an upper dynamic watertightness;

a fourth chamber (37) containing additional feeding powder adapted to free gases produced during combustion of the additional feeding powder at a point located below the perforation to be treated, so as to create a lower dynamic watertightness; and means (33, 34) for igniting the powders contained in the third (36) and fourth (37) chambers once the combustion of the dehydration powder is completed.

16. The device as set forth in claim 15, further comprising a fifth chamber (43) containing placement and cleaning powder.

17. The device as set forth in claim 14, wherein said means for automatically igniting the powder contained in the second chamber includes a fuse ignited by the combustion of the powder contained in the first chamber.

18. A device for the treatment of a perforation area (22) of a well, comprising:

means for localizing and positioning (19, 20) the device inside the well;

a first chamber (32) containing a dehydration powder and adapted to free gases produced during combustion of the dehydration powder and located close to the perforation area (22) to be treated;

a second chamber (40) containing composite powder and adapted to free gases and other components produced during combustion of the composite powder at a point located in an upper level of the perforation area (22) to be treated, while providing them with a helical movement;

means (23, 24, 26) for igniting the powder contained in the first chamber (32); and means (35) for automatically igniting the powder contained in the second chamber (40) once the combustion is completed in the first chamber (32).

19. The device as set forth in claim 18, further comprising:

a third chamber containing feeding powder and adapted to free gases produced during combustion of the feeding powder at a point located above the perforation area to be treated, so as to create an upper dynamic watertightness;

a fourth chamber containing additional feeding powder and adapted to free gases produced during combustion of the additional feeding powder at a point located below the perforation area to be treated, so as to create a lower dynamic watertightness; and means for igniting the powders contained in the third and fourth chambers once the combustion of the dehydration powder is completed.

20. The device as set forth in claim 19, further comprising a fifth chamber containing placement and cleaning powder.

21. A procedure for the treatment of a perforation of a well, comprising the following successive steps:

(a) arranging, close to the perforation to be treated, a dehydration powder chamber that produces a large volume of high pressure gas at a high temperature, as well as a composite powder chamber designed to treat the perforation;

(b) igniting the dehydration powder; and (c) once the combustion of the dehydration powder is complete, igniting the composite powder so the treatment of the perforation can take place; and further comprising during step (a), positioning feeding powder chambers having feeding powder and capable of freeing the gases created during the combustion of the feeding powder at points located, respectively, above and below the perforation (50, 54) to be treated;

before igniting the composite powder, igniting the feeding powder so as to create dynamic watertightness above and below the perforation (50, 54) to be treated; and maintaining the combustion of the feeding powder for at least the duration of the combustion of the composite powder.

22. A device for treating a perforation of a well, comprising:

means for localizing and positioning the device inside the well;

a first chamber containing dehydration powder and adapted to free gases produced during combustion of the dehydration powder and located close to the perforation to be treated;

a second chamber containing composite powder and adapted to free gases and other components produced during the combustion of composite powder at a point located close to the perforation to be treated;

means for igniting the powder contained in the first chamber;

means for igniting the powder contained in the second chamber once the combustion in the first chamber is complete;

a third chamber containing feeding powder and adapted to free gases produced during combustion of the feeding powder at a point located above the perforation to be treated, so as to create an upper dynamic watertightness;

a fourth chamber containing additional feeding powder and adapted to free gases produced during combustion of the additional feeding powder at a point located below the perforation to be treated, so as to create a lower dynamic watertightness; and means for igniting the powders contained in the third and fourth chambers once the combustion of the dehydration powder is completed.

23. A device for treating a perforation of a well, comprising:

a mechanism that localizes and positions the device inside the well;

a first chamber containing dehydration powder and adapted to free gases produced during combustion of the dehydration powder and located close to the perforation to be treated;

a second chamber containing composite powder and adapted to free gases and other components produced during the combustion of composite powder at a point located close to the perforation to be treated;

a first chamber ignition mechanism that ignites the powder contained in the first chamber; and a second chamber ignition mechanism that automatically ignites the powder contained in the second chamber once the combustion in the first chamber is complete.

24. The device as set forth in claim 23, wherein said a second chamber ignition mechanism that automatically ignites the powder contained in the second chamber includes a fuse ignited by the combustion of the powder contained in the first chamber.

* * * * *